United States Patent [19]

Danna

[11] 3,963,595

[45] June 15, 1976

[54] ELECTRODE ASSEMBLY FOR AN ELECTROLYTIC CELL

[75] Inventor: Peter A Danna, Devonshire, Bermuda

[73] Assignee: Olin Corporation, New Haven, Conn.

[22] Filed: June 24, 1974

[21] Appl. No.: 482,301

[52] U.S. Cl. ..... 204/258; 204/266; 204/278; 204/286; 204/288

[51] Int. Cl.[2] ..... C25B 1/26; C25B 1/34; C25B 9/02; C25B 11/02

[58] Field of Search ..... 204/242, 252, 256, 266, 204/258, 278, 286, 288

[56] References Cited

UNITED STATES PATENTS

| | | | |
|---|---|---|---|
| 3,342,717 | 9/1967 | Leduc | 204/252 X |
| 3,477,938 | 11/1969 | Kircher | 204/266 |
| 3,591,483 | 7/1971 | Loftfield et al. | 204/266 X |
| 3,632,497 | 1/1972 | Leduc | 204/266 X |
| 3,871,988 | 3/1975 | Harke et al. | 204/266 X |

*Primary Examiner*—John H. Mack
*Assistant Examiner*—A. C. Prescott
*Attorney, Agent, or Firm*—James B. Haglind; Donald F. Clements; Thomas P. O'Day

[57] ABSTRACT

An electrode assembly is provided for use in electrolytic cells employing metal electrodes. The electrode assembly utilizes an electrode plate, an electrically-conductive surface and a conductive support having a first section attached to and substantially perpendicular to the electrode plate; and a second section substantially parallel to the electrode plate and attached to the first section and to the electrically-conductive surface.

The electrode assembly is employed in electrolytic cells for producing chlorine and caustic soda or oxychlorine compounds by the electrolysis of alkali metal chloride solutions.

9 Claims, 5 Drawing Figures

ELECTRODE ASSEMBLY FOR AN ELECTROLYTIC CELL

The invention relates to electrolytic cells for the electrolysis of aqueous salt solutions. More particularly this invention relates to electrode assemblies employed in electrolytic cells for the electrolysis of aqueous alkali metal chloride solutions.

Electrolytic cells have been extensively used in the preparation of chlorine and caustic or oxychlorine compounds such as chlorates by the electrolysis of brine in a number of different cell designs. One of the problems in all of these designs is to provide a satisfactory means for conducting current between the electrode wall or plate and the electrode surface.

The employment of metal electrodes as a replacement for graphite electrodes, particularly as the anode, has led to the development of electrodes, for example in diaphragm or chlorate cells, of increased size. The height of graphite anodes was limited to about 30 inches, by the electrical resistance of graphite and also by the maximum allowable gas void fraction in the interelectrode gap. The use of highly conductive foraminous metal electrodes, however, permits employment of anodes having a height of at least 48 inches.

U.S. Pat. Nos. 3,591,483 and 3,707,454 issued to R. E. Loftfield et al, disclose anode assemblies for use with electrolytic cells where the cell bottom serves as the anode plate and an anode riser projects upward from it and is attached to the anode surface.

However, in cells where the electrodes are secured to the sides of the cell, an improved conductor is needed which will effectively conduct current between the electrode surface and the electrode plate; which will provide adequate support for the electrode surface; and which will permit electrodes of increased height to be used while requiring as short a length of conductor as is necessary to carry the required electrical current.

It is an object of the present invention to provide a novel electrode assembly useful in electrolytic cells for the production of chlorine and oxychlorine compounds.

An additional object of this invention is to provide a novel electrode assembly useful in electrolytic cells employing metal anodes.

A further object of the present invention is to provide a novel conductive support useful in electrolytic cells in which the electrode plates are positioned vertically.

These and other objects of the present invention are accomplished in an electrode assembly comprised of an electrode plate, an electrically-conductive surface and at least one conductive support having a first section and a second section. The first section is attached to and substantially perpendicular to the electrode plate. A second section of the conductive support, substantially parallel to the electrode plate, is attached to the first section and to the electrically-conductive surface. The conductive support passes current between the electrode plate and the electrically-conductive surface.

In an alternate embodiment, the conductive support has a third section which is substantially parallel to the first section and which is attached to the second section and to the electrode plate.

Accompanying FIGS. 1–5 illustrate the novel electrode assembly of the present invention. Corresponding parts have the same numbers in all Figures.

Figures 1, 2, 3, 4, 5:
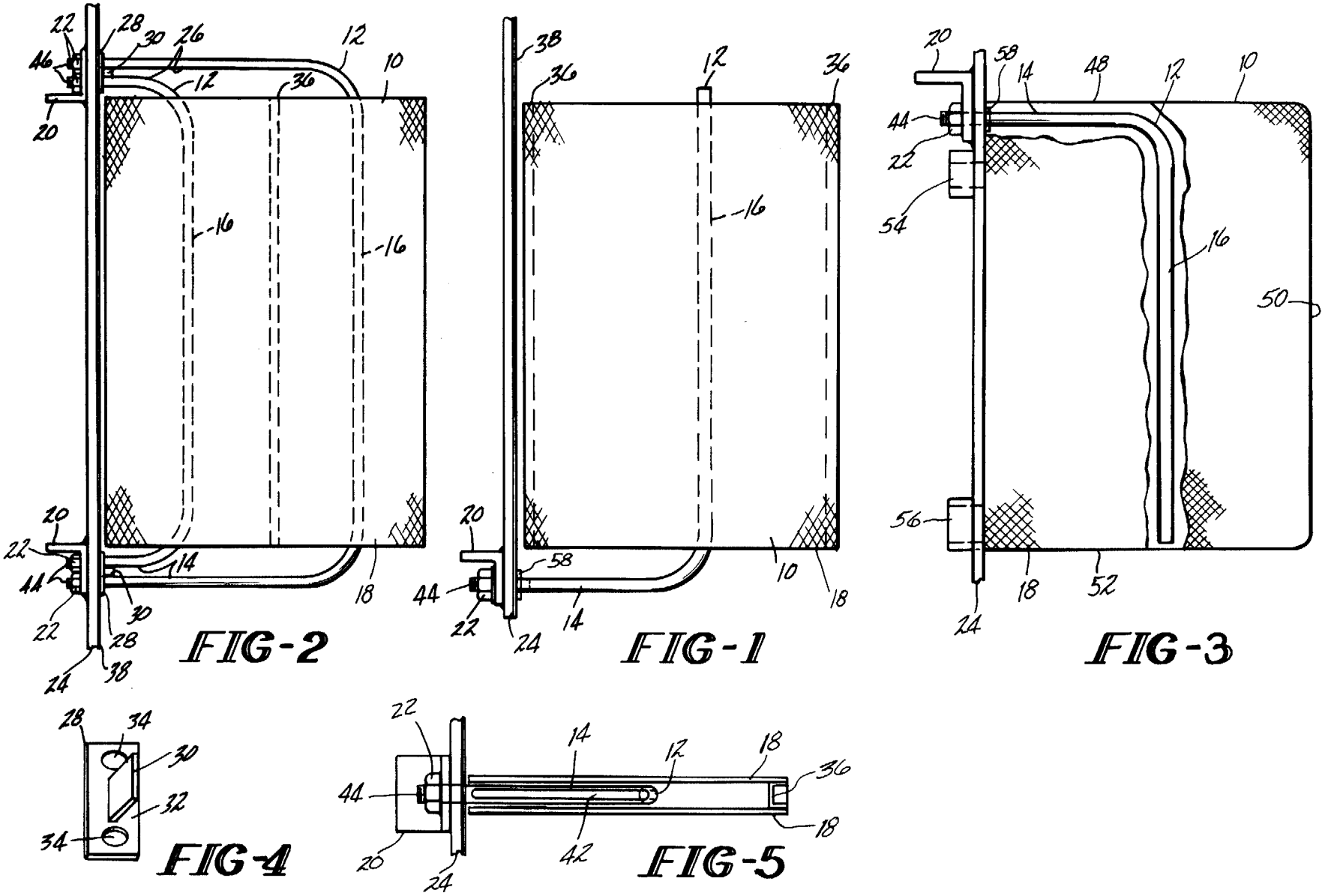
FIG. 1 is a plan view of one embodiment of the novel electrode assembly of the present invention.
FIG. 2 is a plan view of an alternate embodiment of the novel electrode assembly of the present invention.
FIG. 3 illustrates a plan view of an electrode assembly serving as the cathode in a diaphragm cell with portions of the electrically-conductive surface partially broken away.
FIG. 4 is a perspective view of one embodiment of a positioning element employed in the present invention.
FIG. 5 is a top view of another embodiment of the conductive support used in the novel electrode assembly of the present invention.

The electrode assembly in FIG. 1 employs an electrode plate 24 and an electrode 10 composed of a conductive support 12 and an electrode surface 18. Protective coating 38 is sealed to electrode plate 24 on the side adjacent to electrode 10. Conductive support 12 has a vertical section 16, to which electrode surface 18 is welded as an integral unit, and a horizontal section 14 which is substantially perpendicular to electrode plate 24. Horizontal section 14 has a flange 58 near threaded end 44 which passes through openings in protective coating 38, electrode plate 24 and conductor 20. Horizontal section 14 is secured by the contact of flange 58 with protective coating 38 and to conductor 20 by nut 22. Conductor 20 is welded to electrode plate 24. Braces 36, such as metal rods, channels or the like are attached by welding or the like to electrode surface 18 to provide further support.

An alternate embodiment is shown in FIG. 2 which employs a pair of conductive supports 12 having as integral units, lower horizontal sections 14, vertical sections 16 and upper horizontal sections 26. Electrode surface 18 is welded to vertical sections 16. Positioning element 28, having divider 30, is welded to lower horizontal sections 14. Divider 30 maintains the lower horizontal sections 14 at a predetermined distance from one another. Similarly, upper horizontal sections 26 are welded to a second positioning element 28 and are spaced apart by divider 30. Brace 36, such as a metal rod is attached to electrode surface 18 to provide additional support in the vertical direction. Lower horizontal sections 14 have threaded ends 44 which pass through openings in protective layer 38, electrode plate 24 and conductor 20 and are secured to conductor 20 by nuts 22. Similarly, upper horizontal sections 26 have threaded ends 46 which pass through openings in protective layer 38, electrode plate 24, and conductor 20 and are secured in the same manner.

When the electrode assembly serves as a cathode in a diaphragm cell, as illustrated in FIG. 3, electrode 10 is sealed along upper edge 48, side edge 50 and lower edge 52 to form a liquid impervious catholyte container. Electrode surface 18 is directly attached to electrode plate 24. Conductive support 12, having horizontal section 14 and vertical section 16 as an integral unit, is attached to the inner side of electrode surface 18 along horizontal section 14 and vertical section 16. Horizontal section 14 passes below sealed upper edge 48 and vertical section 16 terminates above sealed lower edge 52. Gas outlet 54 and catholyte liquor outlet 56 permit passage of gaseous and liquid products formed within the cathode to be removed through electrode plate 24. Conductive support 12 is attached to conductor 20 and electrode plate 24 in a manner similar to the conductive support 12 of FIG. 1.

Shown in FIG. 4, is a perspective view of one embodiment of positioning element 28 comprised of a plate 32 having openings 34 through which pass the horizontal sections 14 of conductive supports 12 of the embodiment of FIG. 2. Divider 30 is secured substantially perpendicular to plate 32 and maintains a separation between the horizontal sections 14 or 26 of conductive support 12 which are attached by welding or the like to positioning element 28.

The top view of an alternate embodiment of conductive support 12 of the type similar to FIG. 1 is illustrated in FIG. 5 except that horizontal section 14 is directly attached to electrode surface 18. Horizontal section 14 is provided with channel 42 permitting liquids and gases to pass through. This embodiment permits horizontal section 14 to be directly attached to electrode surface 18 when for example, the electrode assembly serves as an anode in a diaphragm cell or a cathode in a chlorate cell. However similar channels 42 can be located in vertical section 16 of cathodes of this invention when used in diaphragm cells, as described more fully below.

The electrode assembly of the present invention may be employed as an anode or a cathode, for example, in electrolytic cells suitable for the production of chlorine and caustic soda or oxychlorine compounds such as hypochlorites or chlorates.

It will be understood that, depending on whether the electrode assembly of the present invention serves as the anode or cathode, the materials of construction for the conductive support will be suitably selected to be resistant to the gases and liquids to which it is exposed. For example, when serving as an anode, the conductive support is suitably a conductive metal such as copper, silver, or aluminum covered by a chlorine-resistant metal such as titanium or tantalum. Where the electrode assembly serves as the cathode, the conductive support is suitably steel, nickel or the like.

Where the electrode surface serves as the anode, while a non-metallic material such as graphite may be used, it is preferred to employ a valve metal such as titanium or tantalum or a metal, for example steel, copper or aluminum clad with a valve metal such as tantalum or titanium. The valve metal has a thin coating over at least part of its surface of a platinum group metal, platinum group metal oxide, an alloy of a platinum group metal or a mixture thereof. The term "platinum group metal" as used in the specification means an element of the group consisting of ruthenium, rhodium, palladium, osmium, iridium and platinum.

The anode surface may be in various forms, for example solid sheets, perforated plates and in the case of metal, as expanded metal or screen.

As the cathode, the electrode surface is suitably a metal screen or mesh where the metal is, for example, iron, steel, nickel, or tantalum. If desired, at least a portion of the cathode surface may be coated with a platinum group metal, oxide or alloy as defined above.

The electrode plates are suitably constructed of nonconductive materials, such as concrete or fiber-reinforced plastic or a conductive metal such as steel or copper. To avoid corrosive damage, the conductive metal may be covered with, for example, hard rubber or a plastic such as polytetrafluoroethylene or fiber reinforced plastic. If desired, titanium may be used where the electrode plate serves as the anode plate.

When assembled in the electrolytic cell, the electrode plates may be positioned horizontally, vertically or with one electrode plate, such as the anode plate, positioned horizontally and the other electrode plate positioned vertically. In a preferred embodiment, the electrode plates are positioned vertically.

One end of the first section of the conductive support is attached to the electrode plate by any suitable means such as bolting, welding, soldering or the like. The same type of attachment means may be used when the third section of the conductive support is employed.

The other end of the first section of the conductive support is attached to the second section of the conductive support by any suitable attachment means such as welding, threaded connections and the like. When the third section is used, it is similarly attached. In a preferred embodiment, the first and second sections are made as an integral unit, and when a third section is used, it is preferably an integral unit with the first and second sections.

The electrically conductive surface (electrode surface) is attached to the second section of the conductive support for example by welding, soldering, brazing or the like. The second section of the conductive support will normally be attached to the back side of the electrode surface. When conductive metals are employed, a pair of electrode surfaces may be used to form the electrode. The second section of the conductive support is preferably attached to the sides of each electrode surface not facing the cathode.

When the electrode assembly has a pair of electrode surfaces and is used in an electrolytic cell for producing oxychlorine compounds, it may be desirable, as shown in FIGS. 1 and 2, not to attach the first or third sections to the electrode surfaces. This allows space between the first (and third) section of the conductive support and the outer edge of the electrode surface for the flow of fluids between the electrode surfaces.

Where the electrode plate is positioned horizontally, for example, when the electrode plate serves as the cell bottom or cell top, it may be desirable to attach the first section of the conductive support to the electrode surface. In the embodiment illustrated by FIG. 5, the first section of the conductive support is attached to the electrode surfaces and is provided with an opening to permit fluids to flow between the electrode surfaces.

In a preferred embodiment of the present invention, the electrode assembly is used as an anode in a diaphragm cell where the electrode plates are positioned vertically.

A plurality of electrodes are attached to the electrode plates, the exact number depending on the size of the electrode plate. For example, in an electrolytic cell employing the electrode assembly of the present invention, from about 2 to about 100 or more, or preferably from about 5 to about 50 electrodes are attached to the electrode plate.

The electrode assembly of the present invention may be employed in electrolytic cells for the electrolysis of aqueous salt solutions, for example, an alkali metal chloride such as sodium chloride or potassium chloride. Where a diaphragm or permselective cation-exchange membrane is employed, chlorine and an alkali metal hydroxide are produced. If the diaphragm or membrane is omitted, oxy-chlorine compounds such as alkali metal hypochlorites or alkali metal chlorates are obtained. Illustrative types of diaphragm cells include those of U.S. Pat. Nos. 1,862,244; 2,370,087; 2,987,463; 3,461,057; 3,617,461 and 3,642,604. Particularly suitable are diaphragm cells in which the anodes and cathodes are mounted on opposite side walls of the cell, for example, in U.S. Pat. Nos. 3,247,090 or 3,477,938. Suitable examples of non-diaphragm cells include U.S. Pat. Nos. 2,799,643; 3,700,582 and 3,732,153.

The following example is presented to illustrate the invention more fully. All parts and percentages are by weight unless otherwise indicated.

EXAMPLE

A diaphragm cell was employed comprised of a cylindrical cell body arranged in a horizontal position having an opening at each end which was sealed by an electrode plate. The electrode plates, positioned vertically, were composed of fiber-reinforced plastic and were bolted to a flange surrounding the openings in the cell body. The electrode plates supported the weight of the cell body in addition to that of the electrodes. An electrode assembly, as illustrated in FIG. 2, served as the anode assembly for the cell.

In each anode, two conductive supports were used to support and conduct current to a pair of electrode surfaces. Each conductive support was composed of a copper rod clad with titanium having an outside diameter of 0.75 inch. The first, second and third sections of each conductive support were formed as an integral unit.

One conductive support had a first and a third section extending horizontally about 27 inches from the anode plate. The other conductive support had a first section and a third section extending horizontally about 9 inches from the anode plate. The first and third sections of each conductive support passed through an opening in the electrode plate and were bolted to copper bus bars welded to the back of the electrode plate. The second (or vertical) sections of the two conductive supports were equal in length. The vertical section of each of the conductive supports was welded to the back side of each of the electrode surfaces. Two titanium positioning plates were used to maintain the relative positions of the two conductive supports. Each plate, as illustrated in FIG. 4, had two openings and a divider between the openings. One positioning plate was welded to each of the first sections of the two conductive supports, near the threaded ends. The second positioning plate was welded to the third sections of each of the conductive supports near the threaded ends. The threaded ends of the conductive supports were placed through the openings in the electrode plate and secured by nuts to bus bars attached to the electrode plate. The electrode surfaces comprised of two sheets of titanium metal in the expanded mesh form, each 48 inches high and 36 inches wide. The outer surface of the mesh was coated with a platinum metal oxide layer. The anode section had 28 anodes attached to the plate, each spaced apart about 2.5 inches between centers.

The cathode section was comprised of 27 cathodes. A cathode included a series of copper rods to which a steel screen was attached. Deposited on the screen was an asbestos fiber diaphragm. The cathodes were 48 inches high, 36 inches wide and about ⅞ inch thick. The cathodes were welded to the cathode plate and 27 cathodes, spaced apart about 2.5 inches between centers, made up the cathode section.

In the assembled cell, each cathode was inserted between two adjacent anodes.

An aqueous solution containing 300 grams per liter of sodium chloride at a temperature of about 78°C was introduced into the cell body through a brine inlet in the cathode plate. The cell operated at a current of 84 kiloamperes and a voltage of 3.33 volts to electrolyze the salt solution to produce chlorine, hydrogen and sodium hydroxide. The catholyte liquor obtained had a sodium hydroxide concentration of about 128 grams per liter. The chlorine gas obtained had a hydrogen content of 0.67 percent. Over a period of about 20 days, the cell was operated at an average current efficiency of 96.3 percent, based on chlorine production.

What is claimed is:

1. An electrode assembly comprising:
a. an electrode plate positioned vertically,
b. an electrically-conductive surface, and
c. at least one conductive support having a first section and a second section, said first section being attached to and substantially perpendicular to said electrode plate, said first section being spaced from and not attached to said electrically-conductive surface, said second section being substantially parallel to said electrode plate, and attached to said first section and to said electrically-conductive surface, said conductive support conducting electric current between said electrode plate and said electrically-conductive surface.

2. The electrode assembly of claim 1 in which said first section and said second section are made as an integral unit.

3. The electrode assembly of claim 1 in which said conductive support has a third section substantially parallel to said first section and attached to said electrode plate and to said second section, said third section being spaced from and not attached to said electrically-conductive surface.

4. The electrode assembly of claim 1 in which a positioning element is attached to said first section of each of a pair of said conductive supports to separate said conductive supports by a predetermined distance.

5. An anode assembly comprising:
a. an electrode plate positioned vertically,
b. an electrically-conductive surface,
c. at least one conductive support having a first section and a second section, said first section being attached to and substantially perpendicular to said electrode plate, said first section being spaced from and not attached to said electrically-conductive surface, said second section being substantially parallel to said electrode plate, and attached to said first section and to said electrically-conductive surface, said conductive support conducting electric current between said electrode plate and said electrically-conductive surface.

6. The anode assembly of claim 5 in which said first and said second sections are made as an integral unit.

7. The anode assembly of claim 5 in which said conductive support has a third section substantially parallel to said first section and attached to said electrode plate and to said second section, said third section being spaced from and not attached to said electrically-conductive surface.

8. The anode assembly of claim 5 in which a positioning element is attached to the first section of each of a pair of said conductive support to separate said conductive supports by a predetermined distance.

9. A diaphragm cell for the electrolysis of an aqueous solution of an alkali metal chloride containing the anode assembly of claim 5 and at least one cathode having a diaphragm deposited on said cathode wherein said cathode is attached to an electrode plate positioned vertically and opposite said anode assembly.

* * * * *